US011480397B2

(12) United States Patent
Disori et al.

(10) Patent No.: US 11,480,397 B2
(45) Date of Patent: Oct. 25, 2022

(54) STACKABLE CORE SYSTEM FOR PRODUCING CAST PLATE HEAT EXCHANGER

(71) Applicant: United Technologies Corporation, Farmington, CT (US)

(72) Inventors: Michael A. Disori, Glastonbury, CT (US); Carl R. Verner, Windsor, CT (US); Steven J. Bullied, Pomfret Center, CT (US); David Donald Chapdelaine, Ellington, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 459 days.

(21) Appl. No.: 16/271,308

(22) Filed: Feb. 8, 2019

(65) Prior Publication Data

US 2020/0025467 A1 Jan. 23, 2020

Related U.S. Application Data

(60) Provisional application No. 62/647,091, filed on Mar. 23, 2018.

(51) Int. Cl.
*B22C 9/10* (2006.01)
*B22C 9/20* (2006.01)
(Continued)

(52) U.S. Cl.
CPC ..... *F28F 3/08* (2013.01); *B21D 53/04* (2013.01); *B22C 7/02* (2013.01); *B22C 9/103* (2013.01);
(Continued)

(58) Field of Classification Search
CPC .. B22C 7/02; B22C 9/10; B22C 9/101; B22C 9/103; B22C 9/26; B22C 9/20
(Continued)

(56) References Cited

U.S. PATENT DOCUMENTS 4,089,302 A 5/1978 Ensink
5,296,308 A 3/1994 Caccavale et al.
(Continued)

FOREIGN PATENT DOCUMENTS

| | | |
|---|---|---|
| EP | 0794393 | 9/1997 |
| EP | 1247601 | 10/2002 |
| GB | 488591 | 7/1938 |

OTHER PUBLICATIONS

The Extended European Search Report for EP Application No. 19164079.6, dated Apr. 29, 2019.

*Primary Examiner* — Kevin P Kerns
(74) *Attorney, Agent, or Firm* — Carlson, Gaskey & Olds, P.C.

(57) ABSTRACT

A method of forming a cast heat exchanger plate includes forming at least one hot core plate defining internal features of a one piece heat exchanger plate and at least one first set of interlocking features. At least one cold core plate is formed defining external features of the heat exchanger plate and at least one second set of interlocking features. A core assembly is assembled wherein each hot core plate is directly interlocked to the at least one cold core plate. A wax pattern is formed with the core assembly. An external shell is formed over the wax pattern. The wax pattern is removed to form a space between the core assembly and the external shell. The space is filled with a molten material and cures the molten material. The external shell is removed. The core assembly is removed. A core assembly for a cast heat exchanger is also disclosed.

13 Claims, 10 Drawing Sheets

(51) Int. Cl.

| | |
|---|---|
| ***B22C 9/26*** | (2006.01) |
| ***B22C 7/02*** | (2006.01) |
| ***F28F 3/08*** | (2006.01) |
| ***B21D 53/04*** | (2006.01) |
| *F28D 7/16* | (2006.01) |
| *F28F 1/02* | (2006.01) |
| *F28F 3/04* | (2006.01) |
| *F28F 7/02* | (2006.01) |
| *F28F 1/26* | (2006.01) |
| *F28F 1/04* | (2006.01) |
| *F28F 21/08* | (2006.01) |

(52) U.S. Cl.
CPC ..... *B22C 9/20* (2013.01); *B22C 9/26* (2013.01); *F28D 7/1653* (2013.01); *F28D 7/1684* (2013.01); *F28F 1/022* (2013.01); *F28F 1/025* (2013.01); *F28F 1/045* (2013.01); *F28F 1/26* (2013.01); *F28F 3/048* (2013.01); *F28F 7/02* (2013.01); *F28F 21/08* (2013.01)

(58) Field of Classification Search
USPC ..... 164/369, 137
See application file for complete search history.

(56) References Cited

U.S. PATENT DOCUMENTS

| | | | | |
|---|---|---|---|---|
| 6,134,785 | A * | 10/2000 | Walter et al. ..... | B23P 15/008 29/890.054 |
| 7,377,746 | B2 | 5/2008 | Brassfield et al. | |
| 8,813,812 | B2 | 8/2014 | Kamel et al. | |
| 9,315,663 | B2 | 4/2016 | Appleby et al. | |

* cited by examiner

STACKABLE CORE SYSTEM FOR PRODUCING CAST PLATE HEAT EXCHANGER

CROSS-REFERENCE TO RELATED APPLICATION

This application claims priority to U.S. Provisional Application No. 62/647,091 filed on Mar. 23, 2018.

BACKGROUND

A plate fin heat exchanger includes adjacent flow paths that transfer heat from a hot flow to a cooling flow. The flow paths are defined by a combination of plates and fins that are arranged to transfer heat from one flow to another flow. The plates and fins are created from sheet metal material brazed together to define the different flow paths. Thermal gradients present in the sheet material create stresses that can be very high in certain locations. The stresses are typically largest in one corner where the hot side flow first meets the coldest portion of the cooling flow. In an opposite corner where the coldest hot side flow meets the hottest cold side flow the temperature difference is much less resulting in unbalanced stresses across the heat exchanger structure. Increasing temperatures and pressures can result in stresses on the structure that can exceed material and assembly joint capabilities.

Turbine engine manufactures utilize heat exchangers throughout the engine to cool and condition airflow for cooling and other operational needs. Improvements to turbine engines have enabled increases in operational temperatures and pressures. The increases in temperatures and pressures improve engine efficiency but also increase demands on all engine components including heat exchangers. Improved heat exchanger designs can require alternate construction techniques that can reduce the feasible practicality of implementation.

Turbine engine manufacturers continue to seek further improvements to engine performance including improvements to thermal, transfer and propulsive efficiencies.

SUMMARY

In a featured embodiment, a method of forming a cast heat exchanger plate includes forming at least one hot core plate defining internal features of a one piece heat exchanger plate and at least one first set of interlocking features. At least one cold core plate is formed defining external features of the heat exchanger plate and at least one second set of interlocking features. A core assembly is assembled wherein each hot core plate is directly interlocked to the at least one cold core plate. A wax pattern is formed with the core assembly. An external shell is formed over the wax pattern. The wax pattern is removed to form a space between the core assembly and the external shell. The space is filled with a molten material and cures the molten material. The external shell is removed. The core assembly is removed.

In another embodiment according to the previous embodiment, a top half cold plate is formed defining top surface external features of the one piece heat exchanger plate and a bottom half core plate is formed defining bottom surface external features of the one piece heat exchanger plate and the core assembly is assembled including assembling the top half cold plate and the bottom half core plate to corresponding one of the at least one hot core plates to define top and bottom external features of a completed one piece heat exchanger plate.

In another embodiment according to any of the previous embodiments, structures are formed defining top surface external features and bottom surface external features with wax as part of the wax pattern.

In another embodiment according to any of the previous embodiments, the external features defined by the cold core plate include fin portions extending from top and bottom surfaces of a plate portion of a completed one piece heat exchanger.

In another embodiment according to any of the previous embodiments, the external features are defined by the cold core plate include thermal transfer augmentation features.

In another embodiment according to any of the previous embodiments, the external features defined by the cold core plate include an open cooling channel disposed between at least two plate portions of the completed one piece heat exchanger.

In another embodiment according to any of the previous embodiments, the cold core plate includes a top, a bottom, a lock side and a slip side. Forming the cold plate includes forming the at least one second set of interlocking features to include at least two pedestals on the top of the slip side and two pedestals on the bottom of the lock side and forming at two indentations on a bottom of the slip side and two indentations on the top of the lock side.

In another embodiment according to any of the previous embodiments, the internal features defined by the hot core plate include internal passages extending through a plate portion of a completed one piece heat exchanger plate.

In another embodiment according to any of the previous embodiments, each of the hot core plates includes a top, a bottom, a lock side and a slip side. Forming the hot core plate includes forming the at least one first set of interlocking features as at least two tabs on the bottom of both the lock side and the slip side and forming at least two slots on both the lock side and the slip side.

In another embodiment according to any of the previous embodiments, forming each of the hot core plates includes defining an inlet face and a plurality of inlets corresponding to the internal passages and the slip side defines an outlet face and a plurality of outlets corresponding to the internal passages.

In another embodiment according to any of the previous embodiments, the hot core plates are placed relative to the cold core plates such that the external features defined by the cold core plates are transverse to the internal features defined by the hot core plates.

In another embodiment according to any of the previous embodiments, interlocking one of the at least one first interlocking features and at least one of the second interlocking features with a portion of the wax pattern to secure an orientation between the two hot core plates and the cold core plate.

In another embodiment according to any of the previous embodiments, the cold core plates are spaced apart from the hot core plates and held in a spaced apart orientation by the wax pattern.

In another featured embodiment, a core assembly for a cast heat exchanger includes at least one hot core plate defining internal features of a heat exchanger plate in the cast heat exchanger and at least one first set of interlocking features. At least one cold core plate that includes structures defining external features of the heat exchanger plate and at least one second set of interlocking features. The at least one cold core plate is interlocked with the at least one hot core plate.

In another embodiment according to the previous embodiment, a top half cold plate defines top surface external features of the heat exchanger plate. A bottom half core plate defines bottom surface external features of the heat exchanger plate. The top half cold plate and the bottom half core plate are interlocked to a corresponding one of the at least one hot core plates to define top and bottom external features of a completed one piece heat exchanger plate.

In another embodiment according to any of the previous embodiments, the external features are defined by the cold core plate includes at least one of fin portions and augmentation structures disposed on top and bottom surfaces of the completed heat exchanger plate.

In another embodiment according to any of the previous embodiments, the external features defined by the at least one cold core plate include an open cooling channel disposed between at least two plate portions of the heat exchanger plate.

In another embodiment according to any of the previous embodiments, the at least one cold core plate includes a top, a bottom, a lock side and a slip side. The at least one second set of interlocking features includes pedestals disposed on the top of the slip side and the bottom of the lock side and indentations on the bottom of the slip side and the top of the lock side.

In another embodiment according to any of the previous embodiments, the internal features defined by the at least one hot core plate include internal passages extending through the plate portion in the case heat exchanger.

In another embodiment according to any of the previous embodiments, at least one hot core plate includes a top, a bottom, a lock side and a slip side. The at least one first set of interlocking features includes tabs on the bottom of both the lock side and the slip side and slots on the top of both the lock side and the slip side.

In another embodiment according to any of the previous embodiments, the at least one hot core plate includes features defining an inlet face, an outlet face and a plurality of inlets and outlets corresponding to the internal passages.

In another embodiment according to any of the previous embodiments, the at least one cold core plate is disposed within the core assembly such that the defined external features are transverse to the internal features defined by the at least one hot core plate.

In another embodiment according to any of the previous embodiments, at least two cold core plates are interlocked together and at least three hot core plates interlocked together.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
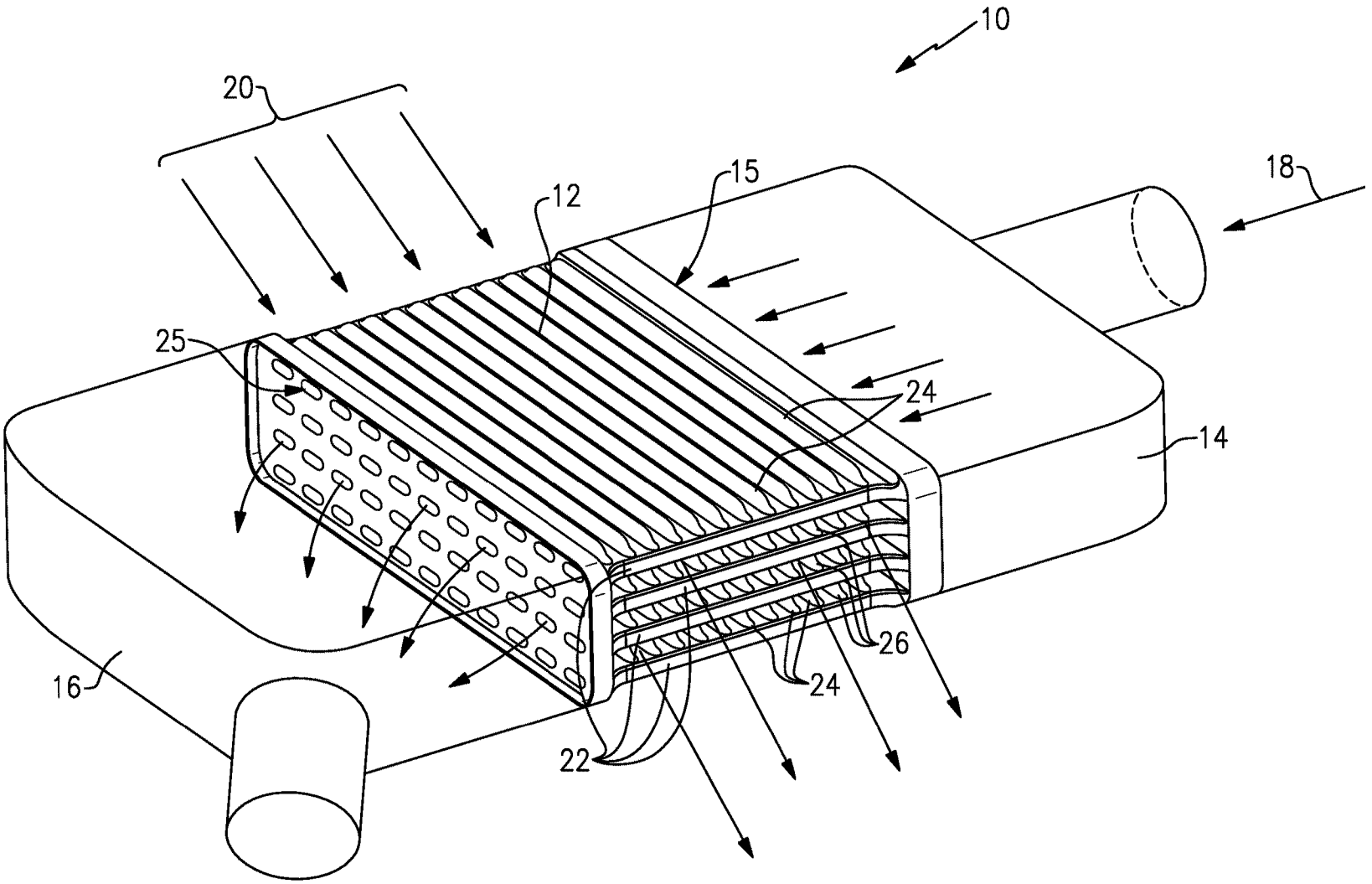
FIG. 1 is a schematic view of an example heat exchanger embodiment.
Figure 2:
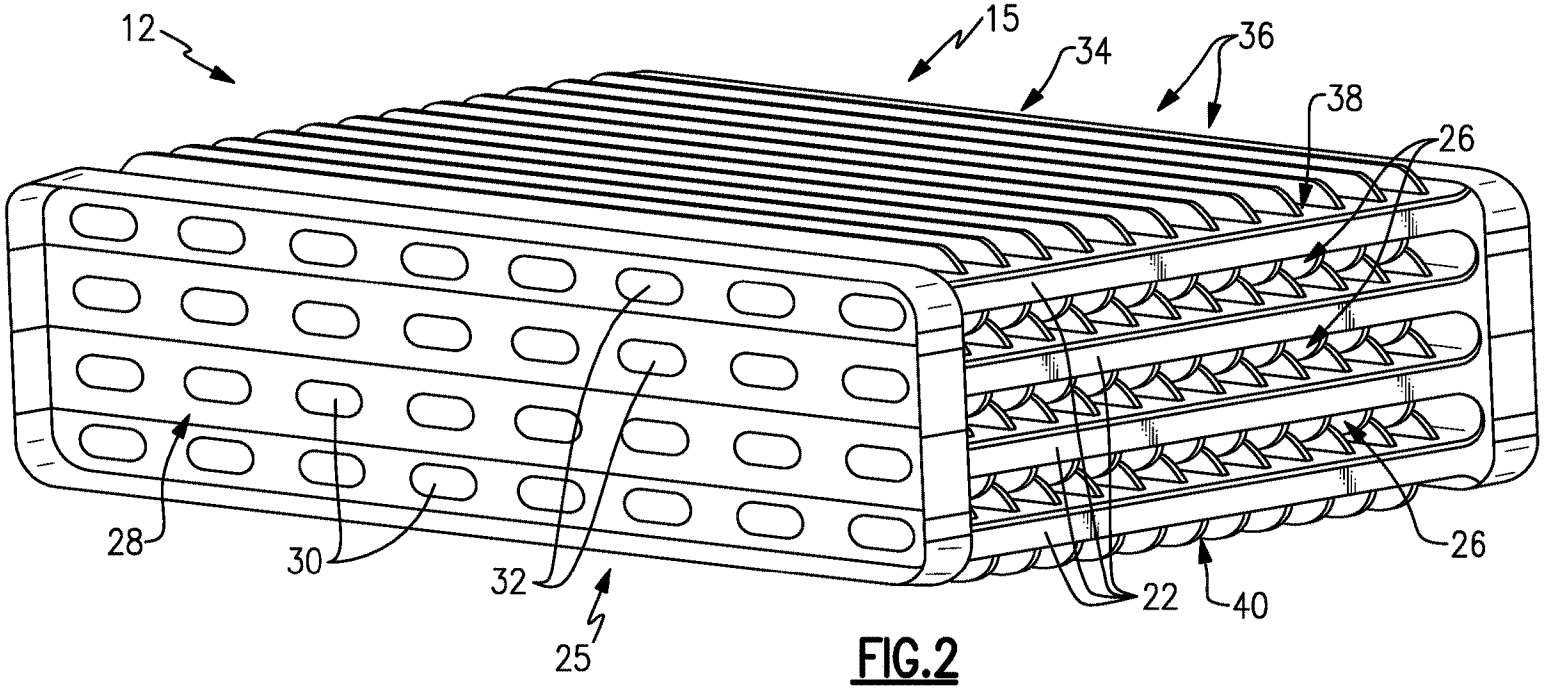
FIG. 2 is a perspective view of an example cast plate embodiment.

Referring to FIGS. 1 and 2, an example a heat exchanger 10 includes a cast plate 12 that is attached to an inlet manifold 14 on an inlet end 15 and an outlet manifold 16 attached to an outlet end 25. A hot airflow 18 is communicated to a plurality of internal passages 32 defined by the cast plate 12 by the inlet manifold 14. A cooling airflow 20 flows over outer surfaces and cooling channels 26 defined by the cast plate 12. The cast plate 12 includes a plurality of plate portions 22 through which the passages 32 are defined for the hot flow 18. The plurality of fins 24 extend from top and bottom surfaces 38, 40 of each plate portion 22 and provide additional surface area for transfer of thermal energy from the hot flow 18 to the cooling flow 20.

The example cast plate 12 is a single piece unitary cast item that includes plate portions 22 that define the plurality of passages 32. Each of the passages 32 extend between an outlet face 28 and an inlet face 34. The inlet face 34 includes the inlets 36 that correspond with the passages 32 through the plate portions 22. The outlets 30 are defined on the outlet face 28. Cooling channels 26 are defined between each of the plate portions 22 and include the fin portions 24 that extend from top and bottom surfaces 38, 40. Moreover, fin portions 24 extend from top and bottom surfaces 38, 40 of the plate portions 22 within the cooling channels 26 such that each of the plate portions 22 include substantially uniform features.

Figure 3:
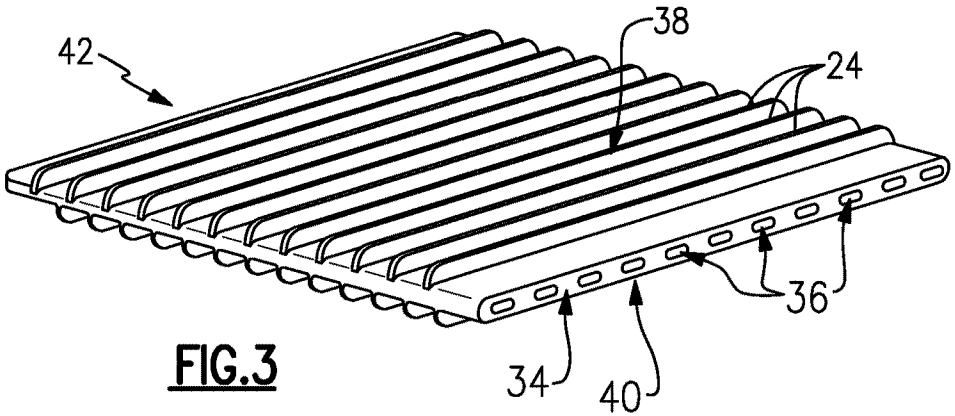
FIG. 3 is a perspective view of another cast plate embodiment.

Referring to FIG. 3, another example cast plate embodiment 42 includes a single plate portion 22 with cooling fins 24 extending from top and bottom surfaces 38, 40. In the cast plate 42, the inlet face 34 is illustrated and shows a plurality of inlets 36. The cast plate 42 is a single unitary part including fin portions 24 that extend upward from both the top surface 38 and bottom surface 40 such that there are no joints between the fin portions 24 and the plate portion 22 or any other features within the cast plate 42. The absence of joints provides for improved durability and enables improved thermal properties that improve performance.

Figure 4:
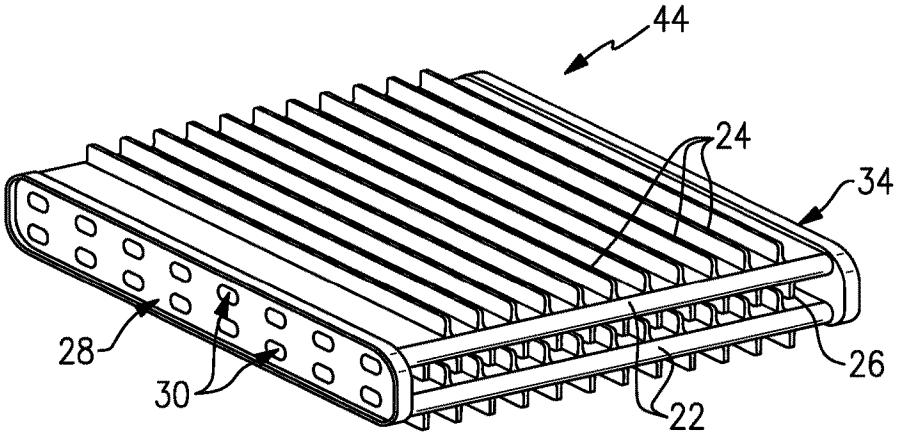
FIG. 4 is a perspective view of yet another cast plate embodiment.
Figure 5:
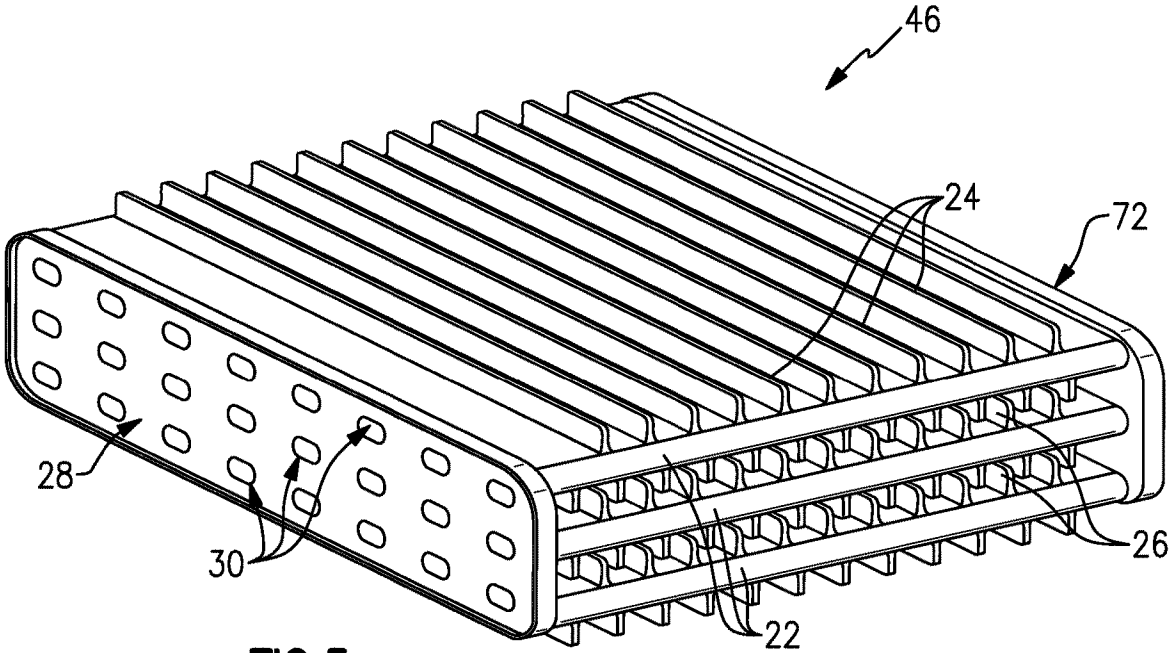
FIG. 5 is a perspective view of still another cast plate embodiment.

Referring to FIGS. 4 and 5, a cast plate 44 and a cast plate 46 are illustrated by way of example to illustrate that the disclosed example cast plate is scalable by including additional plate portions 22 with corresponding top and bottom features including the fin portions 24. As appreciated, each of the plate portions 22 for each of the cast plates 44 and 46 are identical. Moreover, the fin portions 24 are also identical and extend from top and bottom surfaces 38, 40 of each of the plate portions 22.

The cast plate 44 illustrated in FIG. 4 includes one cooling channel 26 disposed between two plate portions 22. Each of the plate portions 22 include the plurality of internal passage 32 disposed between an inlet face 34 and an outlet face 28.

Referring to FIG. 5, the cast plate 46 includes three plate portions 22 with two cooling channels 26 disposed between the plate portions 22. Accordingly, FIGS. 2, 3, 4 and 5 illustrate that the various cast plates 12, 42, 44 and 46 can be provided in a scalable fashion to accommodate different heat removal requirements. Moreover, although cast plate embodiments are illustrated including one, two, three and four plate portions, additional numbers of plate portions are within the contemplation of this disclosure.

Each of the cast plates 12, 42, 44 and 46 is formed as a single unitary structure using a casting process. The casting processes utilizes a core assembly to define the internal and external features and structures. Molten material is introduced into a mold supporting the core assembly and defining internal and external features according to known molding processes. The core assembly is removed once the molten material has solidified to provide the single piece unitary cast plate. As appreciated, a core assembly including multiple plate portions 22 can be complex. A core assembly according to a disclosed embodiment simplifies assembly and enables scalability with common components.

Figure 6:
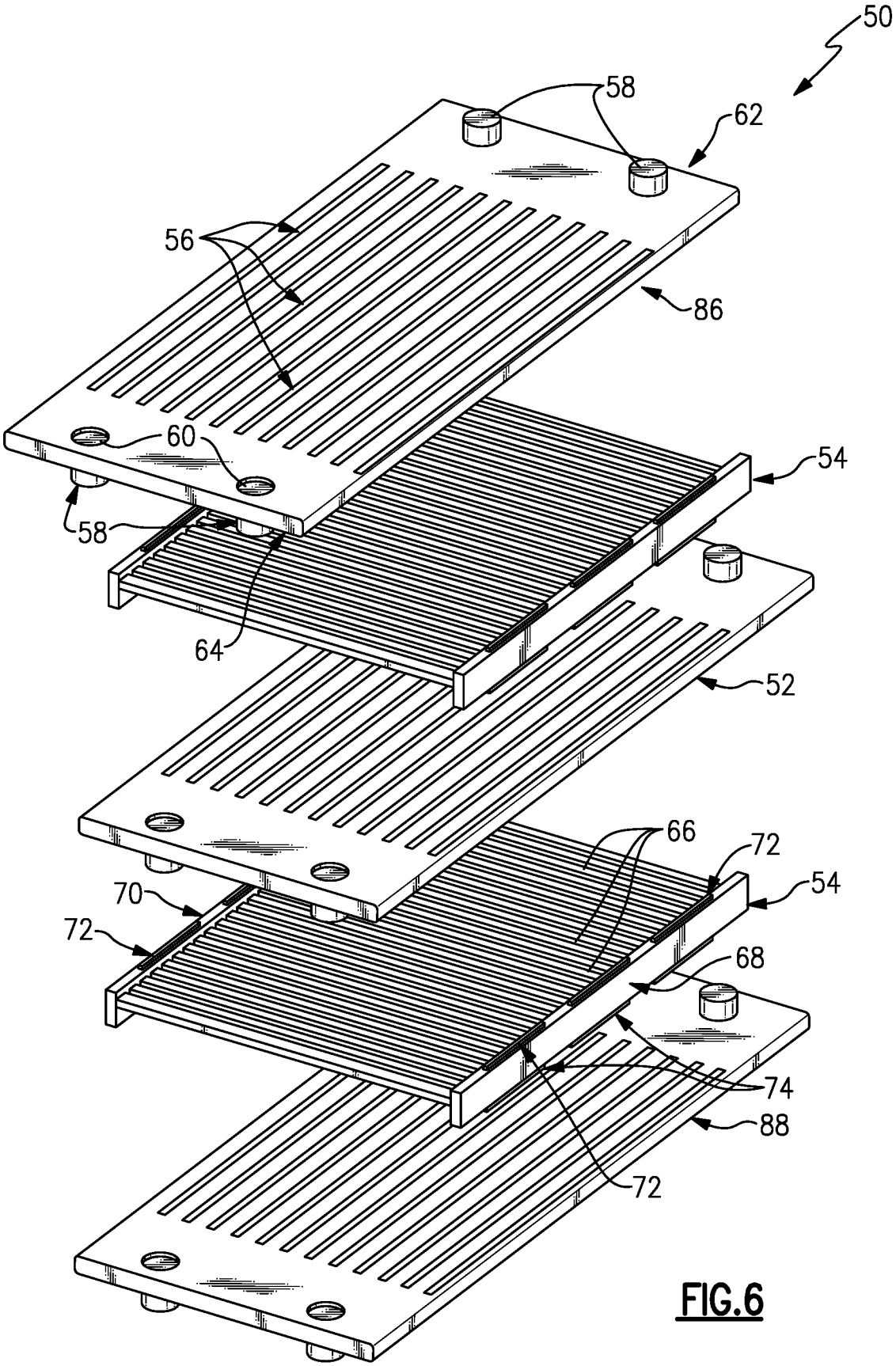
FIG. 6 is an exploded view of an example core assembly.

Referring to FIG. 6 with continued reference to FIGS. 2, 3, 4 and 5, a disclosed example core assembly 50 is schematically shown and is formed utilizing different quantities of identical hot core plates 54, cold core plates 52, top plate 86 and bottom plate 88. Each of the hot core plates 54 are identical and include the same features. Each of the cold core plates 52 are also identical. The top plate 86 and the bottom plate 88 include features to define the corresponding top surface and bottom surface of a completed plate assembly. Accordingly, the top plate 86 and bottom plate 88 include a different configuration as compared to the cold plates 54. The top plate 86 and bottom plate 88 may be the same or may be of a different configuration depending on the desired completed plate configuration. Each of the cold core plates 52 and hot core plates 54 include interlocking features that enable any number of different combinations of hot core plates 54 and cold core plates 52 to be utilized to form the core assembly 50.

Figure 7:
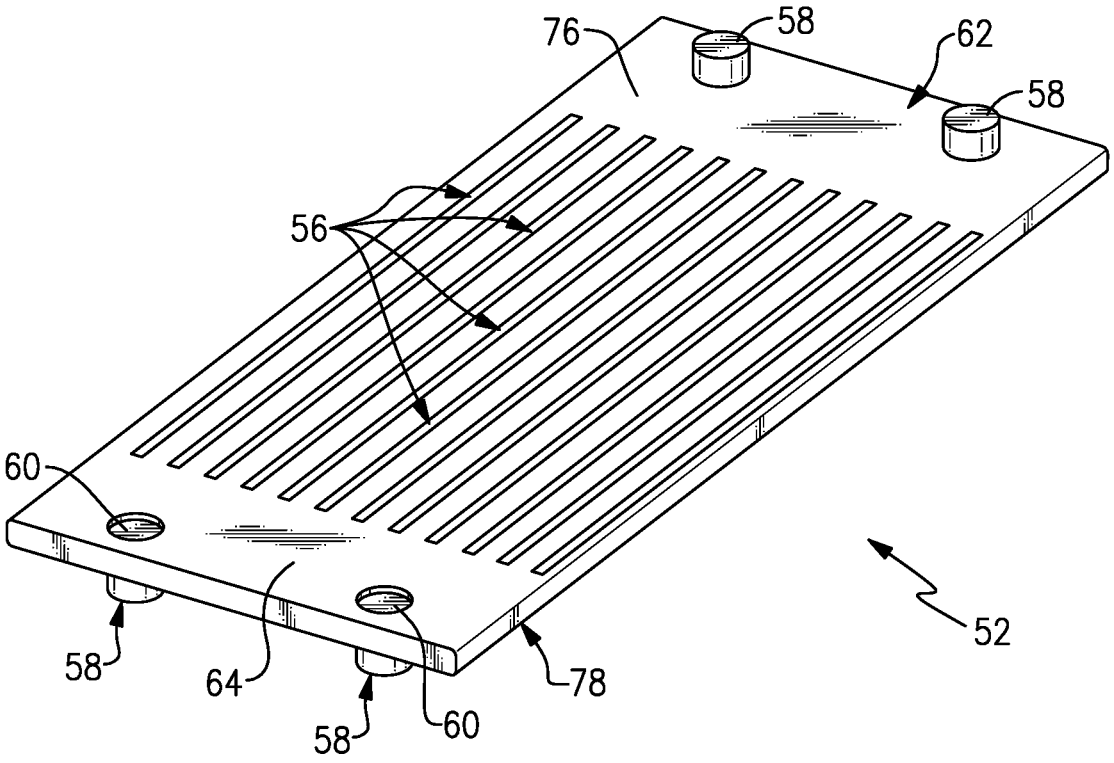
FIG. 7 is a perspective view of an example cold core plate embodiment.

Referring to FIG. 7 with continued reference to FIG. 6, the example cold core plate 52 includes a plurality of structures 56 that define the external features of a completed cast plate. In this example, the structures 56 define a plurality of fin portions 24 that extend from top and bottom surfaces of different plate portions within cooling channels 26 of a completed heat exchanger cast plate. Accordingly, the cold plates 52 include features for defining external features on two different plate portions within the cooling channels 26. The example cold core plate 52 defines the external augmentation features on the plate portion along with the cooling channels 26 that extend through and between plate portions in a completed heat exchanger cast plate.

The top plate 86 and the bottom plate 88 are similarly configured to the cold plates 52 but include structures for forming external features such as the fins on one surface of a single plate portion.

Each of the cold core plates 52, top plate 86 and bottom plate 88 include a second set of interlocking features. In one disclosed example, the second set of interlocking features include pedestals 58 that are receivable within indentations 60. The plate 52 includes a slip side 62 and a lock side 64. In this example, the pedestals 58 extend from a top surface 76 on the slip side 62 and from the bottom surface 78 on the lock side 64. Similarly, indentations 60 are provided on the top surface 76 on the lock side 64 and on a bottom surface 78 on the slip side 62. In this example, there are two pedestals 58 and two corresponding indentations 60 provided on both sides of the cold core plates 52. The placement of pedestals 58 and indentations 60, are provided to enable stacking of the cold core plates 52 in a manner that defines the required spacing and that enables stacking of corresponding hot core plates 54 between the cold core plates 52. The pedestals 58 therefore includes a height that corresponds with a depth of the indentation 60 that maintains the spacing while also preventing lateral movement between linked cold core plates 52.

Figure 8:
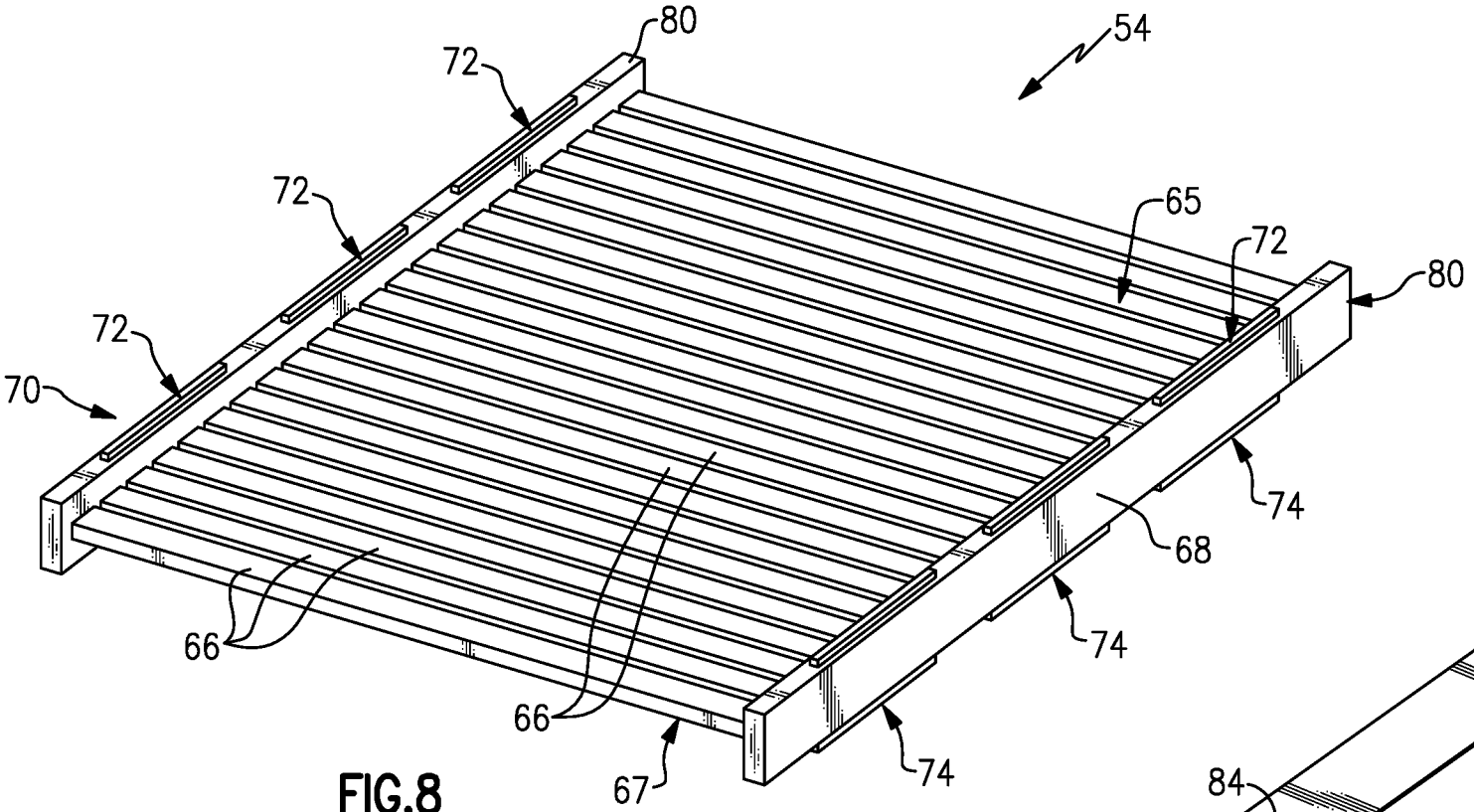
FIG. 8 is a perspective view of an example hot core plate embodiment.

Referring to FIG. 8 with continued reference to FIG. 6, the hot core plate 54 is shown and includes the plurality of structures 66 that define the internal passages 32 of a completed cast plate. Each of the hot plates 54 include a first set of interlocking features. In this example the first set of interlocking features include slots 72 that receive tabs 74. In this example, the top surface 65 of each of the plates 54 include the slots 72 and the bottom surface 67 includes the tabs 74. In this example, the tabs 74 and the slots 72 are defined in sidewalls 80 on both a slip side 68 and a lock side 70.

Figure 9:
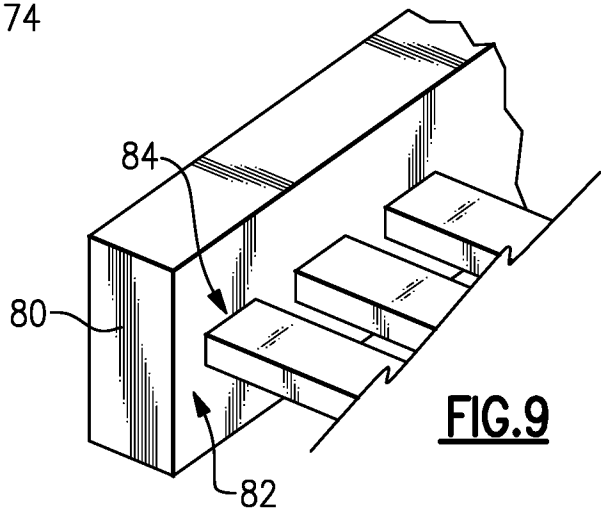
FIG. 9 is an enlarged view of a portion of the example hot core plate embodiment.

Referring to FIG. 9 with continued reference to FIG. 8, the sidewalls 80 include a surface 82 that is utilized to define one of the inlet face 34 and outlet face 28 in a completed cast heat plate. An interface between the structure 66 and interior surface 82 of the wall is generally indicated at 84 and defines the intersection that defines a corresponding outlet or inlet of a completed cast plate and a passage defined by the structure 66.

Figure 11:
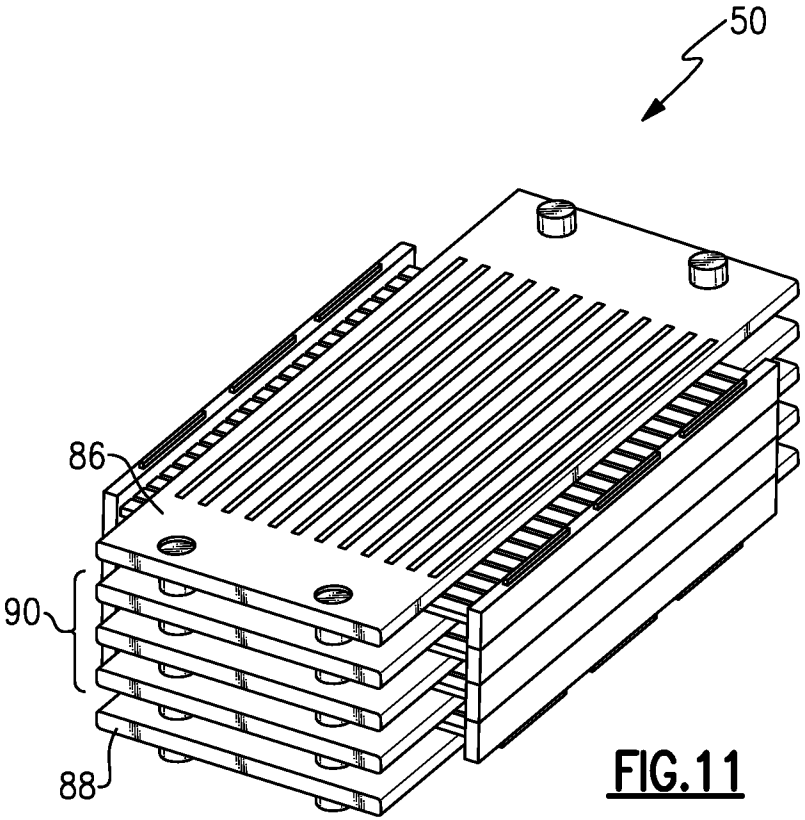
FIG. 11 is a perspective view of an example core assembly.
Figure 10:
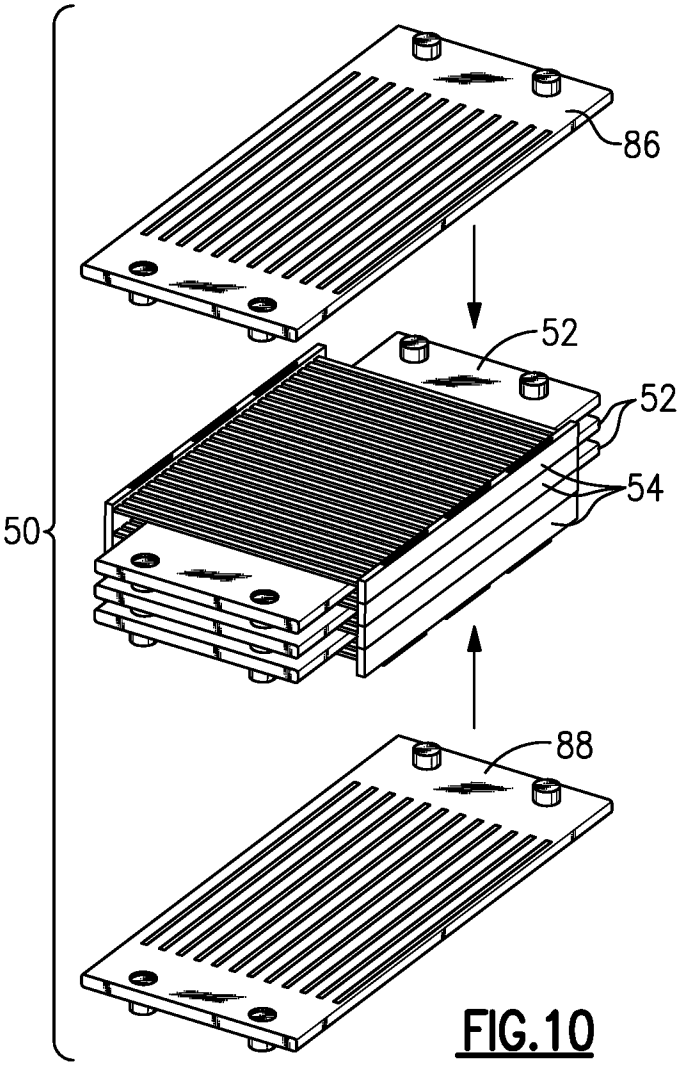
FIG. 10 is a partial exploded view of an example core assembly.

Referring to FIGS. 10 and 11, the use of identical cold core plates 52, top plate 86, bottom plate 88 and hot core plates 54 enable a common configuration for each of the cast plates 12, 42, 44 and 46 regardless of the number of plate portions 22 and cooling channels 26. The use of identical plates 52, 54 enables a scalability when building the core assembly 50 that corresponds with the desired completed cast plate 12, 42, 44 and 46. Regardless of the number of plate portions 22 and cooling channels 26, identical cold core plate 52 and hot core plate 54 are utilized.

In the example illustrated in FIGS. 10 and 11, four hot core plates 54 are stacked one on top of the other with cold core plates 52 disposed within spaces defined between each of the hot core plates 54. The pedestals 58 defined on each one of the cold core plates 52 provides the spacing between the cold core plates 52 that enable the hot core plates 54 to extend there between. Moreover, each of the cold core plates 52 define the external features through the cooling channels 26 of the completed cast plate. Additionally, the top plate indicated at 86 and the bottom plate 88 is utilized to define the fins 24 on the top and bottom plate portions 22 that are not disposed within one of the cooling channels 26 of the completed cast plate 12, 42, 44 and 46.

Referring to FIG. 11, in this example the cold core plates 52 include three intermediate cold core plates 90 that define the cooling channels 26 in the completed cast plate. The top plate 86 and a bottom plate 88 are provided to define the fins 24 on the top and bottom surfaces of the finished cast plate that may not be disposed within one of the cooling channels 26. The use of identical plates 52, 54 enables scaling of the core assembly 50 by stacking additional plates to provide the desired core assembly 50 that provides the configuration of a completed cast plate.

Figure 12:
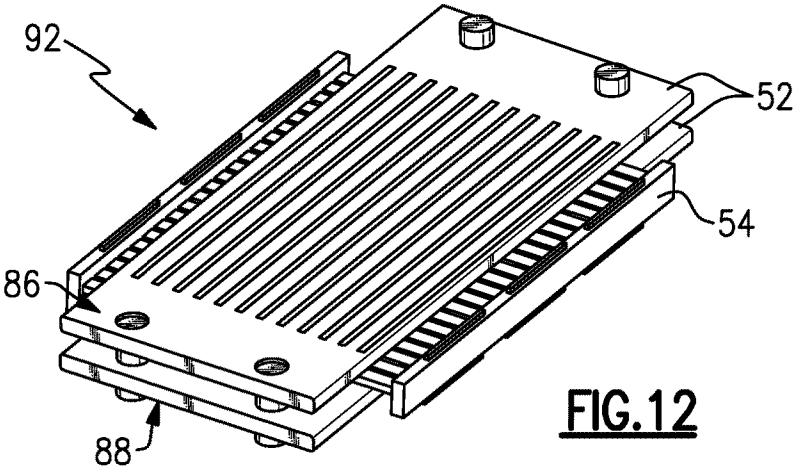
FIG. 12 is a perspective view of another example core assembly.

Referring to FIG. 12, a core assembly 92 is shown that includes two cold core plates 52 disposed above and below a single hot core plate 54. The core assembly 92 would define a single plate portion 22 with fins 24 on top and bottom surfaces 38, 40 to provide a cast plate 42 as is illustrated in FIG. 3.

Figure 13:
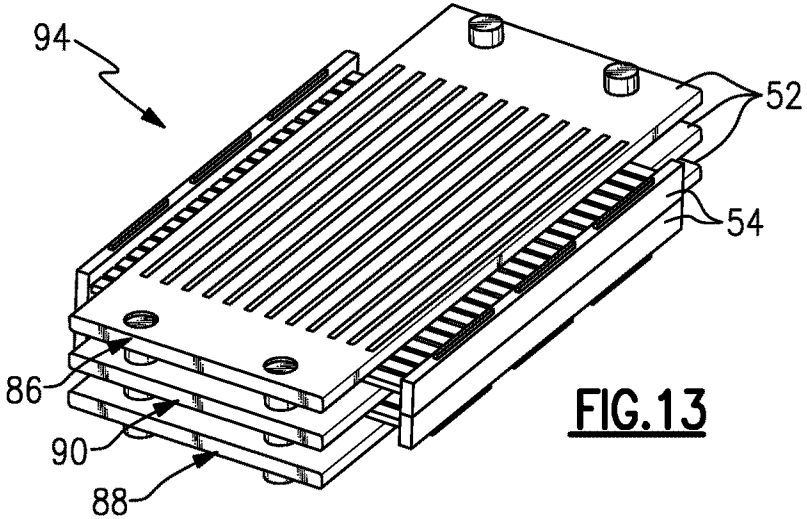
FIG. 13 is an example view of another core assembly embodiment.

Referring to FIG. 13, another core assembly 94 is shown and includes two hot core plates 54 and three cold core plates 52. The core assembly 94 would therefore define two plate portions 22, a single cooling channel 26 and fin portions 24 on top and bottom surfaces 38, 40. The core assembly 94 provides a cast plate 44 as is illustrated in FIG. 4.

Figure 14:
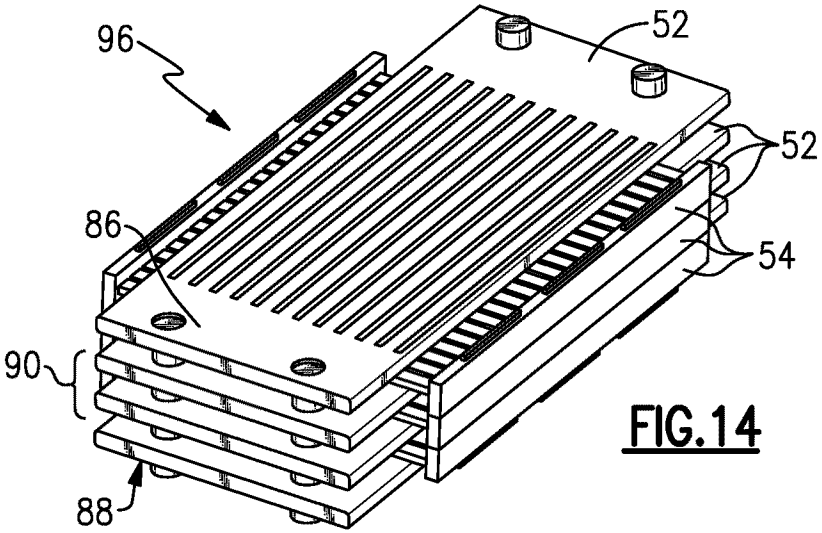
FIG. 14 is a perspective view of yet another core assembly embodiment.

Referring to FIG. 14, another core assembly 96 includes four identical cold core plates 52 and three identical hot core plates 54 to define a cast plate 46 as is illustrated in FIG. 5 and indicated at 46. There are two intermediate cold core plates 90 that are disposed between the hot core plates 54. The four identical cold core plates 52 include a top cold core plate 86 and a bottom core cold plate 88. The top cold core plate 86 and the bottom cold core plate 88 are identical and define fin portions 24 that are not within the cooling channel 26.

Figure 15:
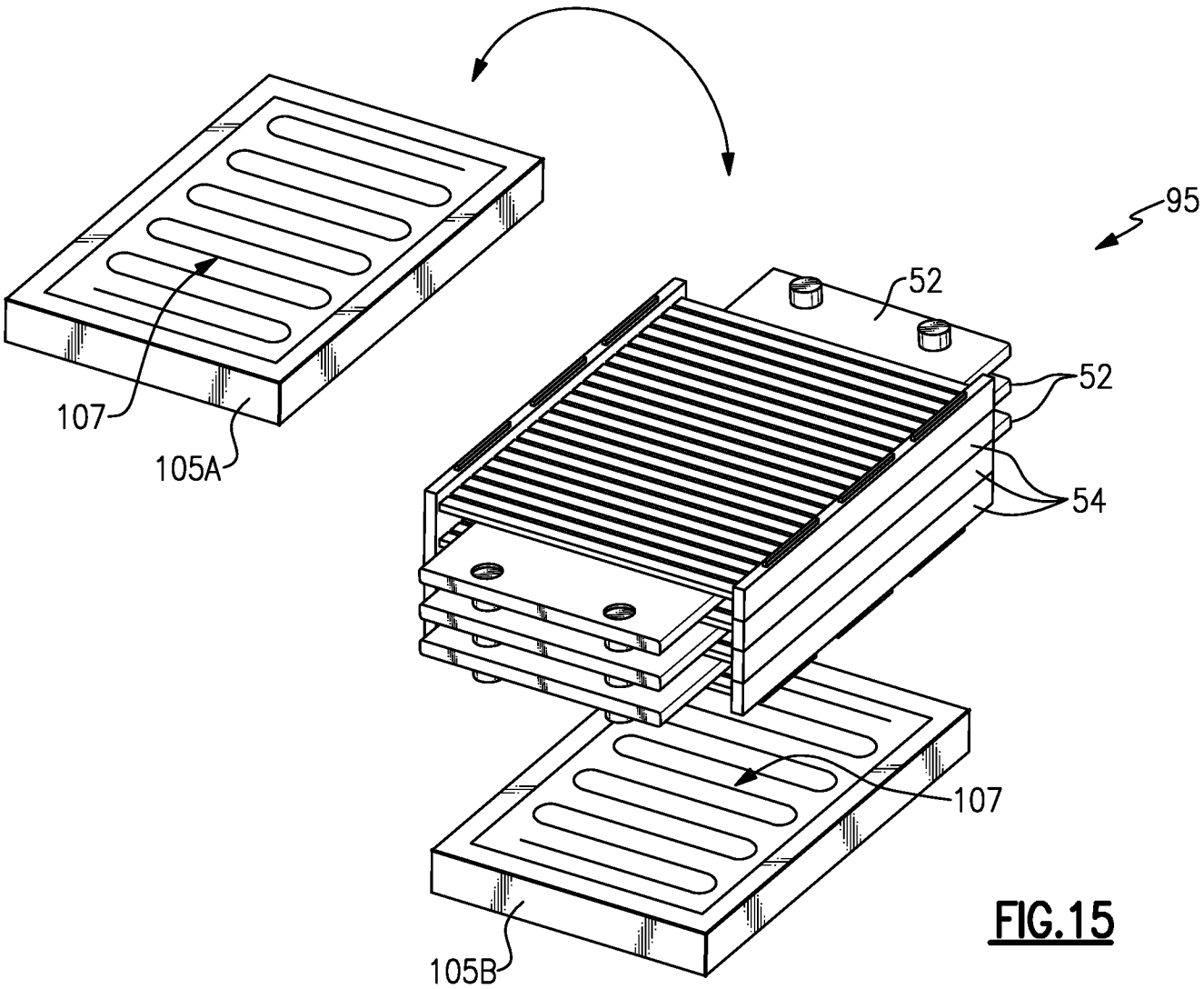
FIG. 15 is a perspective view of yet another core assembly embodiment.

Referring to FIG. 15, another core assembly 95 is shown and includes three identical cold core plates 52 and four identical hot core plates 54. The top plate 86 and the bottom plate 88 is not provided in this example core assembly 95. Instead, a mold including a top portion 105A and a bottom portion 105 B utilized for forming a wax pattern includes features 107 for defining external features on top and bottom surfaces of a completed heat exchanger plate.

Figure 16:
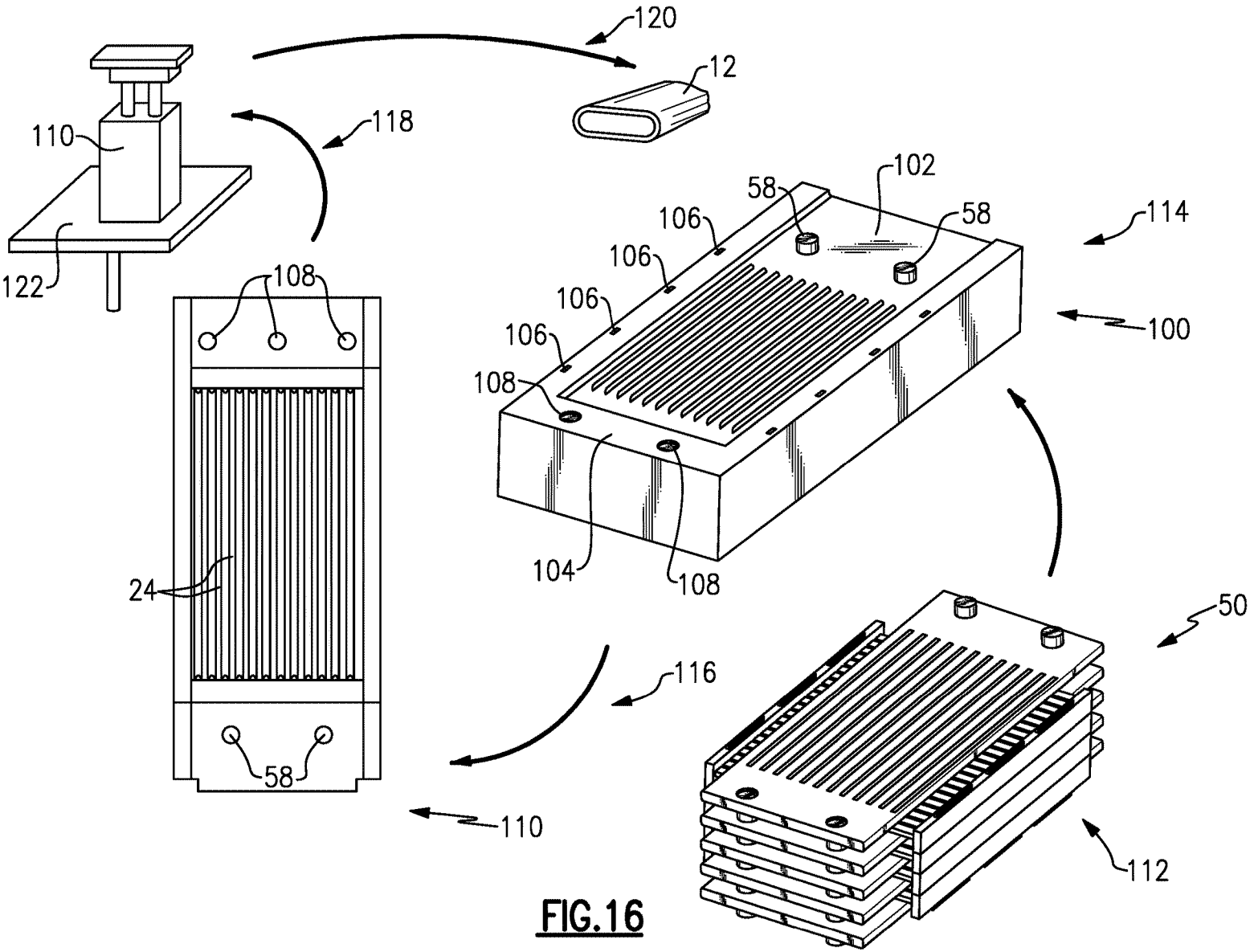
FIG. 16 is a schematic view of an example method of forming a cast plate.

Referring to FIG. 16, a method of casting a cast plate is schematically illustrated and includes the initial step 112 of assembling a core assembly 50 utilizing at least two cold core plates 52 and at least one hot core plate 54. The core assembly 50 can be any of the disclosed core assemblies 50, 92, 94, 96, 95 as well as disclosed possible modifications within the contemplation and scope of this disclosure.

The core assembly 50 is assembled by interlocking corresponding cold core plates 52 and hot core plates 54 in a configuration determined to provide a cast plate including a desired number of plate portions 22, channel portions 26 and fin portions 24.

Once the core assembly 50 is assembled another step indicated at 114 is performed that includes forming a wax pattern shown at 100. The wax pattern 100 surrounds the surfaces of the core plates 52 and 54 and locks the core assembly 50 within a desired orientation. Each of the core plates 52 and 54 are spaced apart from each other and held in the spaced apart orientation by the wax pattern 100. The wax used for the wax pattern 100 interlocks features of the core assembly 50 on a slip side 102 and a lock side 104 to hold it within a desired orientation.

In this example, interlocking is provided by the pedestals 58 of the cold core plates 52 extending through a surface of the wax pattern 100. Additionally, the wax of the wax pattern fills the indentations as is indicated at 108 as well as the open slots 72 on the top surface of the corresponding hot core plates 54 as is indicated at 106. Accordingly, each of the core plates 52 and 54 include features that interlock within the wax pattern 100 to maintain a desired position and orientation of the plates 52, 54 relative to each other.

The method includes the further step indicated at 116 of forming a shell around the wax pattern 100. The example molding method utilizes the wax pattern 100 as a base that is coated with a ceramic slurry material to create a shell with a defined thickness. Once the ceramic slurry has coated the wax pattern 100 to a desired thickness, the wax is removed to form a ceramic shell 110. The ceramic shell 110 includes the core assembly 50. The ceramic shell 110 is utilized for forming the completed cast part. The ceramic shell 110 interlocks with the core assembly 50 to maintain the position of the core plates 52 and 54 during molding operation.

A casting operation as is schematically indicated at 118 is performed using the ceramic shell 110. In one example casting operation, the ceramic shell 110 is mounted within a casting furnace 122 and molten material is introduced into the ceramic shell 110. The molten material is allowed to solidify for a defined time.

Once solidified, the ceramic shell 110, is removed from the casting furnace 122 and the ceramic shell 110 is removed along with the core assembly 50 as is indicated at 120. The ceramic shell 110 and core assembly 50 are removed using known methods and processes. It should be understood, that although an example molding process is disclosed and explained by way of example, other molding and casting processes are within the contemplation of this disclosure.

The example identical cold and hot plates enables construction of different core assemblies for forming different cast plate structures of varying sizes and thermal transfer capabilities.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A core assembly for a cast heat exchanger, the core assembly comprising:

at least one hot core plate defining internal features of a heat exchanger plate in the cast heat exchanger and a first set of interlocking features defined as part of a side wall, the side wall including an interior surface defining one of an inlet face and an outlet face of a completed cast heat exchanger, the first set of interlocking features configured to assemble the at least one hot core plate to another hot core plate and comprises rectilinear slots on one side of the at least one hot core plate and a correspondingly shaped rectilinear tab on an opposite side of the at least one hot core plate; and at least two cold core plates that each include structures defining external features of the heat exchanger plate and a second set of interlocking features, wherein the second set of interlocking features includes a curvilinear slot on one side of the each of the at least two cold plates and a curvilinear tab on an opposite side of each of the at least two cold plates, the at least two cold core plates are configured to interlock together utilizing the second set of interlocking features to define a spacing therebetween, wherein the first set of interlocking features are disposed transversely relative to the second set of interlocking features and the at least one hot core plate is disposed within the spacing separate from and spaced apart from the at least two cold core plates with the first set of interlocking features outside of the spacing between the at least two cold core plates.

2. The core assembly as recited in claim 1, including a top half cold core plate defining top surface external features of the heat exchanger plate and a bottom half cold core plate defining bottom surface external features of the heat exchanger plate and the top half cold core plate and the bottom half cold core plate are interlocked to a corresponding one of the at least two cold core plates to define top and bottom external features of a completed one piece heat exchanger.

3. The core assembly as recited in claim 2, wherein the first set of interlocking features of the at least one hot core plate is not compatible to interlock to either the top half cold core plate or the bottom half cold core plate.

4. The core assembly as recited in claim 1, wherein the external features defined by the cold core plate comprise at least one of fin portions and augmentation structures disposed on top and bottom surfaces of a completed heat exchanger.

5. The core assembly as recited in claim 1, wherein the external features defined by the at least two cold core plates include an open cooling channel.

6. The core assembly as recited in claim 5, wherein the at least two cold core plates includes a top, a bottom, a lock side and a slip side, and the second set of interlocking features includes pedestals disposed on the top of the slip side and the bottom of the lock side and indentations on the bottom of the slip side and the top of the lock side.

7. The core assembly as recited in claim 1, wherein the internal features defined by the at least one hot core plate comprise internal passages extending through a plate portion in the cast heat exchanger.

8. The core assembly as recited in claim 7, wherein at least one hot core plate includes a top, a bottom, a lock side and a slip side, and the first set of interlocking features includes tabs on the bottom of both the lock side and the slip side and slots on the top of both the lock side and the slip side.

9. The core assembly as recited in claim 8, wherein the at least one hot core plate includes features defining an inlet face, an outlet face and a plurality of inlets and outlets corresponding to the internal passages.

10. The core assembly as recited in claim 1, wherein the at least two cold core plates are disposed within the core assembly such that the defined external features are transverse to the internal features defined by the at least one hot core plate.

11. The core assembly as recited in claim 1, including at least two hot core plates interlocked together and at least three cold core plates interlocked together.

12. The core assembly as recited in claim 1, wherein the hot core plate does not interlock with either of the at least two cold plates.

13. The core assembly as recited in claim 1, including a wax pattern that surrounds the surfaces of the at least one hot core plate and the at least two cold core plates and holds the at least one hot core plate in a spaced part orientation relative to the at least two cold core plates.

* * * * *